US008744092B2

(12) United States Patent
Cherigui

(10) Patent No.: US 8,744,092 B2
(45) Date of Patent: Jun. 3, 2014

(54) METHOD FOR TESTING A WIRELESS COMMUNICATION SYSTEM IN CONNECTION WITH A FITTING DEVICE AND A HEARING DEVICE AS WELL AS A COMMUNICATION SYSTEM

(75) Inventor: Fethi Cherigui, Zurich (CH)

(73) Assignee: Phonak AG, Stafa (CH)

( * ) Notice: Subject to any disclaimer, the term of this patent is extended or adjusted under 35 U.S.C. 154(b) by 77 days.

(21) Appl. No.: 13/201,644

(22) PCT Filed: Feb. 19, 2009

(86) PCT No.: PCT/EP2009/051992
§ 371 (c)(1),
(2), (4) Date: Aug. 16, 2011

(87) PCT Pub. No.: WO2009/063097
PCT Pub. Date: May 22, 2009

(65) Prior Publication Data

US 2011/0299693 A1 Dec. 8, 2011

(51) Int. Cl.
*H04R 29/00* (2006.01)
*H04R 25/00* (2006.01)

(52) U.S. Cl.
USPC ..... 381/60; 381/312; 381/315

(58) Field of Classification Search
USPC ..... 381/60, 312–331; 324/655; 455/67.11, 455/67.12, 67.14, 67.7, 67.15
See application file for complete search history.

(56) References Cited

U.S. PATENT DOCUMENTS

2007/0167155 A1* 7/2007 Ishidu ..... 455/423
2007/0230711 A1 10/2007 Hasler et al.
2008/0240453 A1* 10/2008 Westergaard ..... 381/60

FOREIGN PATENT DOCUMENTS

EP 1708306 A1 10/2006
WO 2005/101731 A2 10/2005

OTHER PUBLICATIONS

International Search Report for PCT/EP2009/051992 dated May 18, 2009.
Written Opinion for PCT/EP2009/051992 dated May 18, 2009.

* cited by examiner

*Primary Examiner* — Matthew Eason
(74) *Attorney, Agent, or Firm* — Pearne & Gordon LLP

(57) ABSTRACT

A method for testing a wireless communication system is disclosed comprising a fitting device (1; IF, PC) and at least one of a hearing device (HD1, HD2) and an accessory device (ACC) to the hearing device (HD1, HD2). The fitting device (1; IF, PC) comprising means for communicating with at least one of the hearing device (HD1, HD2) and the accessory device (ACC). The method comprises the steps of:

testing at least one of the following elements:
- a transceiver of the hearing device (HD1, HD2);
- a transceiver of the accessory device (ACC);
- a transceiver of the fitting device (1; IF, PC);
- quality of a link between two transceivers;

comparing results of the testing with predefined values, presenting a result of the comparison to the user of the fitting device (1; IF, PC) by indicating failure or non-failure for the corresponding element tested, wherein the step of testing is controlled by the fitting device (1; IF, PC).

Furthermore, a wireless communication system is disclosed, which is used for implementing the inventive method.

13 Claims, 1 Drawing Sheet

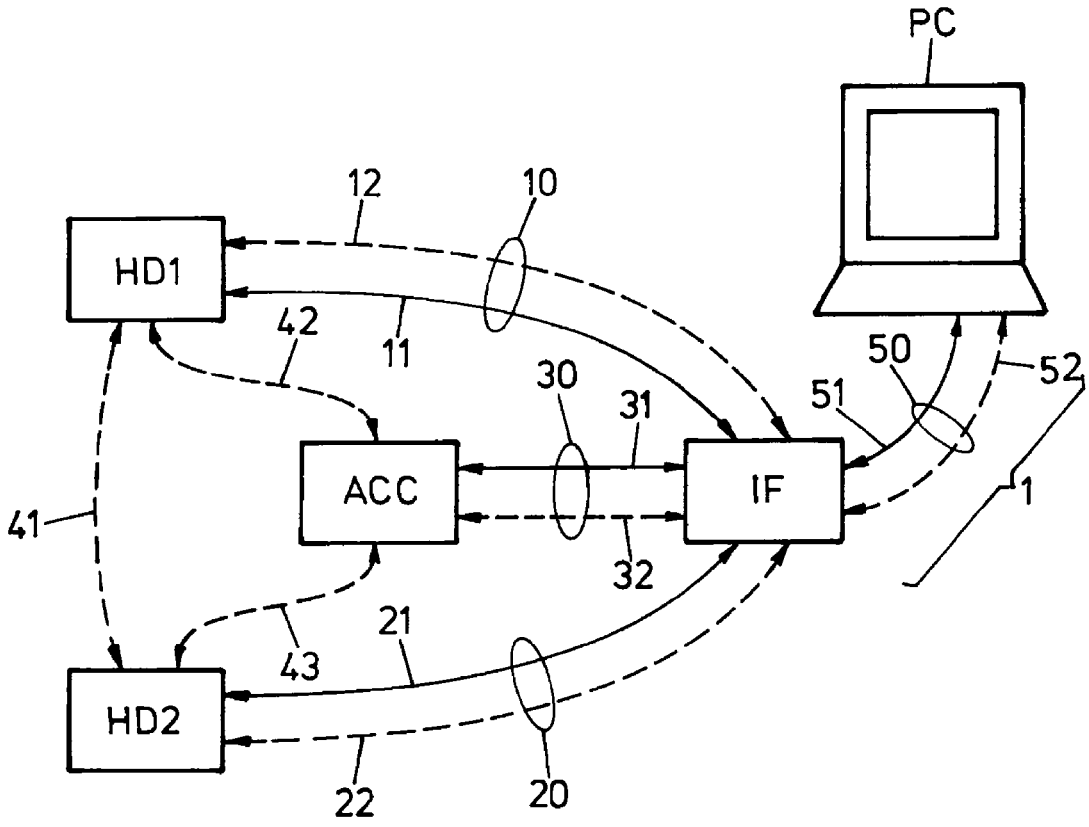
PC
12
10
HD1
42
11
50
52
30
31
51
ACC
IF
1
41
32
21
43
HD2
22
20

METHOD FOR TESTING A WIRELESS COMMUNICATION SYSTEM IN CONNECTION WITH A FITTING DEVICE AND A HEARING DEVICE AS WELL AS A COMMUNICATION SYSTEM

The present invention is related to a method for testing a wireless communication system comprising a fitting device and at least one of a hearing device and an accessory device to the hearing device as well as to a communication system.

The manufacturing of hearing devices with wireless communication facilities requires wireless testing procedures. For BTE-(behind-the-ear) hearing devices, for example, the wireless system is tested and validated at the manufacturing site, i.e. well before the hearing devices are delivered to the fitter that is adjusting the hearing device to the needs of the hearing device user. The proper functionality cannot be guaranteed since the hearing devices, and its possible accessory devices, are exposed to possible stress, such as chock or fall, and aging.

An example for the aging effect is the gluing process that is used to fix the transmission coil within the hearing device housing or within the accessory device housing, respectively. In fact, the transmission coils have to be processed before being inserted in the respective housing. For an ITE-(in-the-ear) hearing device, for example, the transmission coil leads are twisted and glued at the twisting point then fixed on a faceplate that is used for mounting the other components of a hearing device. For a BTE-(behind-the-ear) hearing device, the transmission coil is glued to a holder which is then inserted into the hearing device housing.

It has been realized that the gluing process adds parasitic capacitance, which cannot be determined in advance, and additional losses, which changes the inductance value as well as the Q-factor. A part of the resulting impact is taken into account after coil testing and after a so called Link Distance Test has been performed. All these tests are performed at the manufacturing site. Therefore, any variations in connection with the transmission coil after the hearing devices or the accessory devices, respectively, have been delivered to the fitter, cannot be taken into account anymore. This is in particular disadvantageous since investigations showed that the parasitic capacitance and the damping factor (DF=1/Q) of the glue itself varies over time due to thermal stress. Hence, the Q-factor and the corresponding inductance present a rather large variation.

In addition, with respect to ITE-(in-the-ear) and ITC-(in-the-canal) hearing devices, it has already been proposed to use the LDT-(Link Distance Test) to properly test the wireless link. However, the LDT is rather time consuming and results in higher costs.

Therefore, it is one object of the present invention to provide a method for testing a wireless communication system comprising a fitting device and at least one of a hearing device and an accessory device that do not have the above-mentioned disadvantages.

This and other objects are accomplished by the measures specified in claim 1. Further embodiments of the present invention as well as a communication system for testing hearing devices and its accessory devices are specified in further claims.

The present invention is firstly directed to a method for testing a wireless communication system comprising a fitting device and at least one of a hearing device and an accessory device to the hearing device, the fitting device comprising means for communicating with at least one of the hearing device and the accessory device, the method comprising the steps of:

testing at least one of the following elements:
- a transceiver of the hearing device;
- a transceiver of the accessory device;
- a transceiver of the fitting device;
- quality of a link between two transceivers;

comparing results of the testing with predefined values, presenting a result of the comparison to the user of the fitting device by indicating failure or non-failure for the corresponding element tested, wherein the step of testing is controlled by the fitting device.

The present invention has at least the following advantages: It is a simple, fast and easy method to test the wireless functionality of a wireless hearing system. The end-user or the fitter (audiologist) can run the tests using the fitting device and its adapted software without further hardware or test equipment. Also the software can rely on the device driver for the hearing devices as well as for the accessory device, if need be.

The concept is based on a debug tool that helps to monitor the wireless functionality and the radio hardware status by means of a set of on-chip tests using the application/end-user software. The tests can be executed on a standalone hearing device, an accessory device and/or a pair of hearing devices or a combination of a hearing device and an accessory device. The results give a precise diagnostic of the radio hardware status in a user friendly graphical user interface implemented in the fitting software for fitting hearing devices for being used by the user.

This concept is extendable to wireless self-testing of a hearing device using the fitting device. The self-testing procedure is controlled by the fitting software.

The present invention is not intended to replace the complicated and expensive wireless testing, like the so called LDT-(Link Distance Test), performed at the manufacturing site of a hearing device company because the RF-(radio frequency)-environment is well under control at the manufacturing site. However, the present invention is mainly directed to be used as a debug tool for the audiologists, in the final ITE-(in-the-ear)/ITC-(In-the-canal) hearing device assembly labs as wells as in the worldwide service facilities. Therewith, the quality of hearing devices can significantly be improved because any changes due to ageing, assembling, etc. can now be recognized and those hearing devices or accessory devices that do not fulfill the requirements can be eliminated before delivering it to the end-user.

In a more specific embodiment of the present invention, the hearing device or the accessory device to be tested is connected to the fitting device via a wire before carrying out the step of testing a transceiver of the hearing device or of the accessory device.

The wired connection to the devices, which comprise a transceiver to be tested, enables a stand-alone test of the transceiver in the respective device. It guarantees testing of the corresponding transceiver only while any possible insufficiency of a wireless connection between the fitting device and the device to be tested is eliminated beforehand.

In a still more specific embodiment of the present invention, the step of testing comprises checking a transmission coil of the transceiver using tuning values of a resonant circuit.

In a more specific embodiment of the present invention, the step of testing comprises checking noise floor based on at least one of wide-band Radio Signal Strength Indicator and base-band Radio Signal Strength Indicator.

In a more specific embodiment of the present invention, the step of testing comprises checking a transmitter of a transceiver by using at least one of Radio Signal Strength Indicator, Frame Error Rate and Bit Error Rate. This procedure is used for testing wireless links only.

In a more specific embodiment of the present invention, the step of testing comprises checking a receiver of a transceiver by using Frame Error Rate and equivalent Bit Error Rate in both transmission directions.

A further embodiment of the present invention further comprises the step of wirelessly connecting the fitting device with at least one of the hearing device and the accessory device, tuning values and calibration values of a transmission coil of the at least one of the hearing device and the accessory device are being checked.

Therewith, a wireless connection between the fitting device and the device to be tested is checked in order to detect possible malfunctions.

In a further embodiment of the present invention, the method further comprises the step of monitoring the quality of a wireless link between two hearing devices, or between a hearing device and an accessory device.

In a still further embodiment of the present invention, the method further comprises the step of transmitting the result of the testing via the accessory device to the fitting device.

Furthermore, the present invention is also directed to a wireless communication system comprising:

a fitting device;

at least one of a hearing device and an accessory device to the hearing device, the fitting device comprising means for communicating with at least one of the hearing device and the accessory device, means for testing at least one of the following elements:

a transceiver of the hearing device;

a transceiver of the accessory device;

a transceiver of the fitting device;

quality of a link between two transceivers;

means for comparing results of the testing with predefined values, means for presenting a result of the comparison to the user of the fitting device by indicating failure or non-failure for the corresponding element tested, wherein the fitting device is operationally connected to at least one of a hearing device and the accessory device.

In an embodiment of the present invention, the hearing device or the accessory device to be tested is connected to the fitting device via a wire before carrying out the testing of a transceiver of the hearing device or of the accessory device.

In a further embodiment of the present invention, a transceiver comprises a transmission coil.

In a still further embodiment of the present invention, the means for testing comprises means for checking noise floor based on at least one of wide-band Radio Signal Strength Indicator and base-band Radio Signal Strength Indicator.

In a still further embodiment of the present invention, the means for testing comprises means for checking a transmitter of a transceiver by using at least one of Radio Signal Strength Indicator, Frame Error Rate and Bit Error Rate.

In a still further embodiment of the present invention, the means for testing comprises means for checking a receiver of a transceiver by using Frame Error Rate and equivalent Bit Error Rate in both transmission directions.

The present invention is further explained in more detail by referring to a drawing showing an exemplified embodiment of the present invention.

The only FIGURE shows a communication system according to the present invention comprising a fitting device, two hearing devices and an accessory device.

In the only FIGURE, a communication system is depicted comprising a fitting device 1, two hearing devices HD1 and HD2, and an accessory device ACC. The fitting device 1 comprises an interface unit IF and a calculation unit PC, which is, for example, a commercially available personal computer. The calculation unit PC and the interface unit IF are operationally connected via a cable 51—e.g. an USB-(Universal Serial Bus)-cable—or via a wireless link 52, implementing, for example, the Bluetooth standard. It is pointed out that the interface unit IF may be, in a further embodiment of the present invention, implemented in the calculation unit PC resulting in that the fitting device 1 is a single unit comprising all necessary interface facilities for the tasks to be performed.

The interface unit IF is able to be connected to the hearing devices HD1 and HD2 as well as to the accessory device ACC. A wired and a wireless connection are offered for all the connection 10, 20, 30 to the interface unit IF. As more than one hearing devices HD1 and HD2 are present, e.g. for a binaural hearing system, a wireless link is provided between the two hearing devices HD1 and HD2.

As the present invention is directed to testing wireless connections, the wired connections 11, 21, 31 are made available for certain test procedures that will be described later on. Furthermore, and in view of the fact that the wireless link 41 between the hearing devices HD1 and HD2, and the wireless links 42 and 43 between the accessory device ACC and the hearing devices HD1 and HD2, are being used during regular operation of the hearing system by the hearing device user, a testing and diagnosing is particularly important for these wireless links 41, 42, 43.

According to the present invention, the fitting device 1 has control on all testing procedures that are applied by the fitter or audiologist, i.e. the testing procedures are designed, in first instance, to be applied outside the manufacturing site. In fact, it is a tool implemented in the fitting device 1 in order to give the fitter the possibility to improve and guarantee the well functioning of the wireless links 41, 42, 43 of the communication system comprising the hearing devices HD1 and HD2 as well as the accessory device ACC. As a result, the quality of service for the wireless hearing systems can be better guaranteed, and a possible malfunction can be detected earlier without sending the whole hearing system back to the manufacturer. In fact, it is possible to identify the defective part of the tested wireless hearing system and to only replace the defective part. Therewith, costs and logistic efforts can be reduced significantly.

The present invention is based on a set of tests that can be selected by the fitter or that are automatically selected by the fitting software in dependence on the available hardware structure.

The tests according to the present invention are incorporated at a high software level, at which also the fitting software is implemented. Therewith, the fitter can initiate the test procedures as needed, or the fitting software can initiate test procedures automatically. Thereby, the test procedures make use of the hearing device interface or the accessory device interface, respectively.

The tests used by the present invention can be divided into at least five categories:

A first category is directed for testing standalone hearing devices HD1, HD2 or accessory devices ACC, i.e. the wireless transceiver of only one hearing device HD1, HD2 or accessory device ACC is tested. In this test, the hearing device HD1, HD2 or accessory device ACC is connected with a physical wire (indicated by reference sign 11, 21 and 51 in the FIGURE) to the interface unit IF, via which at least one of the following test procedures is applied:

- A transceiver of the devices present is tested by checking a RF-(Radio Frequency)-coil using tuning values of a resonant circuit that is inherent to every transceiver. Therewith, it is possible to obtain information regarding short/open circuit, broken wires, fractured ferrite core and/or out of resonance behavior, for example.
- The RF-(radio frequency)-environment and/or the noise floor picked-up by the transceiver based on the wide-band RSSI-(Radio Signal Strength Indicator) or the base-band RSSI accumulation, for example (continuous or instantaneous sink of self or RF-(radio frequency)-environment noise) are checked.
- The transceiver of the device to be tested is checked using self-level calibration.

A second category is directed for testing the fitting device 1, respectively the wireless connection between the interface unit IF and the calculation unit PC. In this test, the interface unit IF is wirelessly connected to the calculation unit PC. At least one of the following procedures is applied:

- A transceiver of the calculation unit PC or the interface unit IF, respectively, is tested by checking a RF-(Radio Frequency)-coil using tuning values of a resonant circuit that is inherent to the transceivers. Therewith, it is possible to obtain information regarding short/open circuit, broken wires, fractured ferrite core and/or out of resonance behavior, for example.
- The RF-(radio frequency)-environment and/or the noise floor picked-up by the fitting device transceivers based on the wide-band RSSI-(Radio Signal Strength Indicator) or the base-band RSSI accumulation, for example (continuous or instantaneous sink of self or RF-(radio frequency)-environment noise) are checked.
- The transceivers of the fitting device are checked using self-level calibration.

A third category is directed to testing a wireless link between the two hearing devices HD1 and HD2. Thereto, the hearing devices HD1 and HD2 are connected to the fitting device 1 via cables (indicated by reference sign 11 and 21 in FIG. 1). For the testing of wireless connectivity, at least one of the following procedures is applied:

- The transmitters of each hearing devices HD1 and HD2 are checked by determining base-band Radio Signal Strength Indicator (RSSI). In addition, the FER—(Frame Error Rate) or the BER—(Bit Error Rate) is/are also determined in a further embodiment.
- The receiver of each hearing device HD1 and HD2 are checked by determining the FER—(Frame Error Rate) or BER—(Bit Error Rate).

A fourth category is directed to testing the hardware of a hearing device HD1, HD2 as well as the wireless link between the hearing device HD1, HD2 and the fitting device 1, particularly the interface unit IF. Alternatively, the wireless link may also be directed to the accessory device ACC. For the testing, at least one of the following procedures is applied:

- The hearing device hardware status and tuning parameters are checked as well as the software versions of the embedded software used in connection with the wireless link or the hearing device.
- The tuning values of hearing device RF-(radio Frequency)-coil tuning values are checked, i.e. the tuning values are determined and compared to predefined values.
- The internal radio status is checked and the link quality of the wireless link between the hearing device HD1, HD2 with the fitting device 1 (interface unit IF, accessory device ACC) is monitored.

Finally, a fifth category is directed to testing of a wireless network comprising at least two of the following devices:

- hearing device HD1;
- hearing device HD2;
- accessory device ACC;
- fitting device 1, interface unit IF, respectively.

The corresponding devices form a wireless network (i.e. no physical connections are required), for which at least one of the following procedures is applied for testing:

- The RF-(Radio Frequency)-coil tuning values for a device to be tested as well as its calibration values are determined and compared to preset values defining a range in which proper functioning of the device is guaranteed.
- The internal radio status is checked and the wireless link quality of the devices under test is monitored.

Testing the RF-(Radio Frequency)-coil could be, in one embodiment, handled using the tuning values. This is a very important test that helps to check the Q factor and gives indication about possible broken lead wires and/or core fracture. The lead wires may break if a certain stress is applied to the RF-coil. Further, a dumped Q factor might be due to coil position with respect to the battery and loudspeaker housing after shell assembly. This might in particular be the case for ITE-(in-the-ear) hearing devices.

A change of the Q factor with time due to antenna gluing is likely and leads to parasitic capacitance. Furthermore, the tests are a good indicator for checking the resonance frequency because it helps to show whether the coil is at the edge or out of the tuning range due to a strong magnetization or wrong inductance value.

On the other hand, it is important to measure the amount of RF-(Radio Frequency)-environment noise using a continuous or an instantaneous sink of the RSSI-(Radio Signal Strength Indicator) to be sure that there are no external interferences, which may interfere with the wireless fitting or other wireless functionalities during the test.

In the absence of such external interferences, the test would give the amount of self-noise, which gives an idea about the noise floor in case of assembled ITE-(in-the-ear) shell devices.

Another useful feature is the real-time continuous or instantaneous link quality check using FER-(Frame Error Rate) and equivalent BER-(Bit Error Rate) in both direction when two devices are used. This test is a good indicator of Frame synchronization loss and/or audio dropouts versus link distance and/or external disturbances.

Furthermore, one can image a large set of hearing device wireless self-tests in order to check the internal hardware/software status. The results of these tests are wirelessly communicated to the fitting device 1 (or the interface unit IF, respectively).

For example, one or more of the following tests can be performed:

- check the wireless device serial number;
- check the image software version;
- check inter-chip communication interfaces via read/write or by means of IRQ-(interrupt request) status;
- check fitting parameters and hearing device tuning values "e.g. OSCs tuning values, battery voltage EOL (end of life) and shutdown levels" (compare them with defaults values before the Pro&Go);
- check the hardware logic and memory status by performing a logical and memory bist, if necessary.

check the DSP-(digital signal processor) gain using internal sound generators;

check the hardware external components (e.g. capacitors, resistors, switches, etc.) connection by performing on-chip test boundary scans;

check loudspeaker impedance (loudspeaker type) by doing on-chip measurement technique (using the front-end for analog-to-digital conversion);

check battery status.

The invention claimed is:

1. A method for testing a wireless communication system comprising a fitting device (1; IF, PC) and at least one of a hearing device (HD1, HD2) and an accessory device (ACC) to the hearing device (HD1, HD2), the fitting device (1; IF, PC) comprising means for communicating with at least one of the hearing device (HD1, HD2) and the accessory device (ACC), the method comprising the steps of:

connecting at least one of the hearing device (HD1, HD2) and the accessory device (ACC) to the fitting device via a wire (11, 21, 31);

while the least one of the hearing device (HD1, HD2) and the accessory device (ACC) is connected to the fitting device (1; IF, PC) via the wire (11, 21, 31), testing at least one of the following elements:

a transceiver of the hearing device (HD1, HD2);

a transceiver of the accessory device (ACC);

subsequently testing quality of a wireless link between two transceivers, comparing results of the testing steps with predefined values, presenting a result of the comparison to the user of the fitting device (1; IF, PC) by indicating failure or non-failure for the corresponding element tested, wherein the testing steps are controlled by the fitting device (1; IF, PC).

2. A method for testing a wireless communication system comprising a fitting device (1; IF, PC) and at least one of a hearing device (HD1, HD2) and an accessory device (ACC) to the hearing device (HD1, HD2), the fitting device (1; IF, PC) comprising means for communicating with at least one of the hearing device (HD1, HD2) and the accessory device (ACC), the method comprising the steps of:

connecting at least one of the hearing device (HD1, HD2) and the accessory device (ACC) to the fitting device via a wire (11, 21, 31);

while the least one of the hearing device (HD1, HD2) and the accessory device (ACC) is connected to the fitting device (1; IF, PC) via the wire (11, 21, 31), testing at least one of the following elements:

a transceiver of the hearing device (HD1, HD2);

a transceiver of the accessory device (ACC);

a transceiver of the fitting device (1; IF, PC);

subsequently testing quality of a wireless link between two transceivers, comparing results of the testing steps with predefined values, presenting a result of the comparison to the user of the fitting device (1; IF, PC) by indicating failure or non-failure for the corresponding element tested, wherein the testing steps are controlled by the fitting device (1; IF, PC), and wherein at least one of the testing steps comprises checking a transmission coil of a transceiver using tuning values of a resonant circuit.

3. The method of claim 1 or claim 2, wherein at least one of the testing steps comprises checking noise floor based on at least one of wide-band Radio Signal Strength Indicator and base-band Radio Signal Strength Indicator.

4. The method of claim 1 or claim 2, wherein at least one of the testing steps comprises checking a transmitter of a transceiver by using at least one of Radio Signal Strength Indicator, Frame Error Rate and Bit Error Rate.

5. The method of claim 1 or claim 2, wherein at least one of the testing steps comprises checking a receiver of a transceiver by using Frame Error Rate and equivalent Bit Error Rate in both transmission directions.

6. The method of claim 1 or claim 2, further comprising the step of wirelessly connecting the fitting device (1; IF, PC) with at least one of the hearing device (HD1, HD2) and the accessory device (ACC), tuning values and calibration values of a transmission coil of the at least one of the hearing device (HD1, HD2) and the accessory device (ACC) are being checked.

7. The method of claim 6, further comprising the step of monitoring the quality of a wireless link (12, 22, 41, 42, 43) between two hearing devices (HD1, HD2), or between a hearing device (HD1, HD2) and an accessory device (ACC).

8. The method of claim 1, further comprising the step of transmitting results of the testing steps via the accessory device (ACC) to the fitting device (1; IF, PC).

9. A wireless communication system comprising:

a fitting device (1; IF, PC), at least one of a hearing device (HD1, HD2) and an accessory device (ACC) to the hearing device (HD1, HD2), the fitting device (1; IF, PC) comprising means for communicating with at least one of the hearing device (HD1, HD2) and the accessory device (ACC), means for testing at least one of the following elements:

a transceiver of the hearing device (HD1, HD2);

a transceiver of the accessory device (ACC), wherein the hearing device (HD1, HD2) or the accessory device (ACC) to be tested is connected to the fitting device (1; IF, PC) via a wire (11, 21, 31) before carrying out the testing of a transceiver of the hearing device (HD1, HD2) or of the accessory device (ACC);

means for subsequently testing quality of a wireless link between two transceivers;

means for comparing results of the testing of a transceiver, and results of the testing quality of a wireless link, with predefined values, means for presenting a result of the comparison to the user of the fitting device (1; IF, PC) by indicating failure or non-failure for the corresponding element tested, wherein the fitting device (1; IF, PC) is operationally connected to at least one of a hearing device (HD1, HD2) and the accessory device (AAC).

10. The communication system of claim 9, wherein a transceiver comprises a transmission coil, and the testing of the transceiver comprises checking the transmission coil using tuning values of a resonant circuit.

11. The communication system of claim 9 or claim 10, wherein at least one of the means for testing and the means for subsequently testing comprises means for checking noise floor based on at least one of wide-band Radio Signal Strength Indicator and base-band Radio Signal Strength Indicator.

12. The communication system of claim 9 or claim 10, wherein at least one of the means for testing and the means for subsequently testing comprises means for checking a transmitter of a transceiver by using at least one of Radio Signal Strength Indicator, Frame Error Rate and Bit Error Rate.

13. The communication system of claim 9, wherein at least one of the means for testing and the means for subsequently testing comprises means for checking a receiver of a transceiver by using Frame Error Rate and equivalent Bit Error Rate in both transmission directions.

* * * * *